US005263393A

United States Patent [19]

Long et al.

[11] Patent Number: 5,263,393

[45] Date of Patent: Nov. 23, 1993

[54] DEVICE FOR CARRYING OUT AN OPERATION ON A WEB ACCORDING TO A GIVEN PITCH

[75] Inventors: Michael Long, Rochester, N.Y.; Jacques E. Gaudillat, Chatenoy-En-Bresse, France

[73] Assignee: Eastman Kodak Company, Rochester, N.Y.

[21] Appl. No.: 927,501

[22] PCT Filed: Mar. 11, 1991

[86] PCT No.: PCT/FR91/00191

§ 371 Date: Sep. 17, 1992

§ 102(e) Date: Sep. 17, 1992

[87] PCT Pub. No.: WO91/14550

PCT Pub. Date: Oct. 3, 1991

[30] Foreign Application Priority Data

Mar. 19, 1990 [FR] France ..... 90 00003697

[51] Int. Cl.[5] ..... B26D 1/58; B26D 1/60

[52] U.S. Cl. ..... 83/320; 493/369

[58] Field of Search ..... 83/314, 318, 320; 493/22, 369, 372

[56] References Cited

U.S. PATENT DOCUMENTS

| | | | |
|---|---|---|---|
| 438,239 | 10/1890 | Laffitte | 101/180 |
| 1,031,468 | 7/1912 | Power . | |
| 1,179,885 | 4/1916 | Wiseman . | |
| 1,291,524 | 1/1919 | Howell . | |
| 1,416,168 | 5/1922 | Carleton . | |
| 1,782,570 | 11/1930 | Howell . | |
| 2,220,523 | 11/1940 | Kaganski | 164/89 |
| 2,293,264 | 8/1942 | Leslie | 164/118 |
| 2,841,818 | 7/1958 | Griffith | 17/25 |
| 3,800,646 | 4/1974 | Benz | 83/320 |
| 4,103,575 | 8/1978 | Utsui et al. | 83/298 |
| 4,227,450 | 10/1980 | Krieskorte | 100/214 |
| 4,492,139 | 1/1985 | Forsstrom et al. | 83/727 |
| 4,495,844 | 1/1985 | Jackson et al. | 83/715 |
| 4,928,562 | 5/1990 | Tanimura et al. | 83/278 |

*Primary Examiner*—William E. Terrell

*Attorney, Agent, or Firm*—Charles E. Snee, III

[57] ABSTRACT

The invention concerns a device for carrying out an operation, according to a given pitch, on a uniformeously and continuously moving web.

The device comprises a first block provided with a tool, which describes in a reciprocating motion a small arc of circle around a stationary horizontal axis parallel to the axis of the movement of the web, to make periodically cooperate said tool with a member complementary to said tool, provided on a second block, said first block being connected to said second block at the level of said stationary axis, both blocks such connected and hung to a stationary frame, being driven parallel to the movement axis of said web in a reciprocating motion, the period of which is identical to the period of the motion around said stationary axis.

Application to the perforation, the cutting, the embossing, the notching, the stitching of webs.

22 Claims, 9 Drawing Sheets

DEVICE FOR CARRYING OUT AN OPERATION ON A WEB ACCORDING TO A GIVEN PITCH

Figure 1:
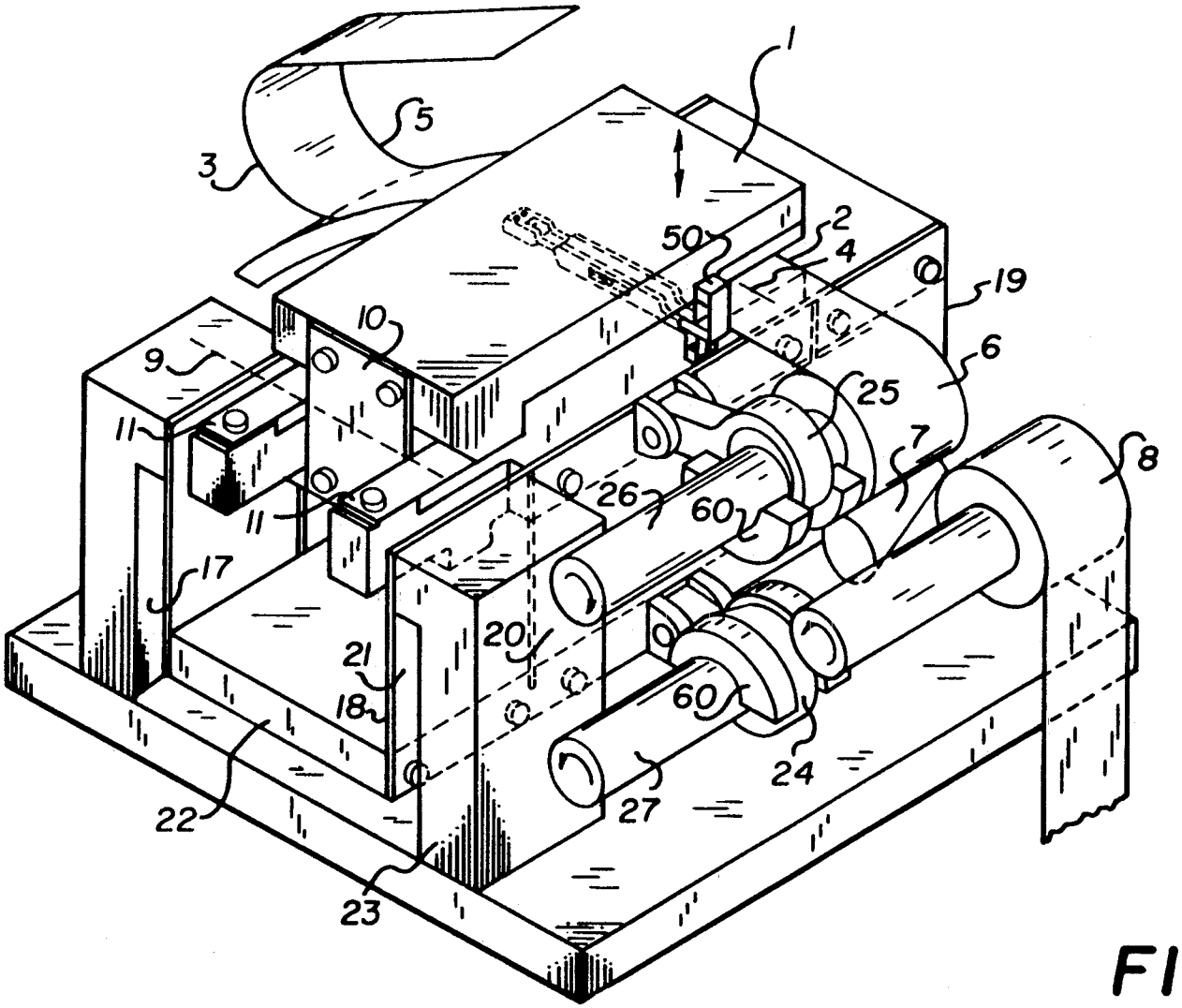

The invention relates to a device for carrying out an operation, according to a given pitch, on a uniformly and continuously movable web; it relates in particular to the perforation of photographic films, and to the cutting, embossing, stitching and notching of web products.

Photographic films, for example, incorporate, parallel to their edges, one or two arrays of perforations making it possible to drive a film in devices for shooting and for projection, and in processing machines. It is known that, in the use of photographic film, the quality of projection, particularly the stability of the image on the screen, is closely dependent on the quality of the perforations, i.e. the regularity of their pitch and the accurate execution of each perforation. In this respect, the tolerance levels required are extremely low, in the order of only a few microns on the finished perforation.

To this end, perforators are usually employed which cut a perforation at the same time on one or both of its edges each time that the film is immobilised between two successive movements of the film in the perforator. The film is driven intermittently in a perforation station by a reciprocating mechanism using a claw which engages in a perforation made previously by an alternative punch which perforates the film. In order to obtain a precisely reproducible pitch, a cooperating pin is used which moves with the punch. This pin is usually situated between the punch and the claw, at a distance from the punch equal to the pitch of the perforations. This is arranged so that the pin penetrates inside the perforation which was cut previously before the punch comes into contact with the film; the purpose of this is to position the film with great precision under the punch before the perforation is made. This pin, which enters without play into the perforation, corrects small errors in positioning of the film due to the claw.

Thus, patent FR 2 093 796 describes a perforator for punching perforations on a web according to a regular pitch; it comprises a punch block support arm joined along a horizontal axis on a die block support arm, and it also consists of a feed mechanism for driving the web step by step, said mechanism being composed of a claw driven by an arm mounted on an offset part, a perforation station for cutting the perforations, and a reception mechanism which cooperates with the accurately perforated web, in order to accurately position the web to be perforated in the reception station. Particularly on account of the arrangement of the punch and die block support arms in relation to the direction of movement of the web, such a device can only realise one hole at a time on each side of the web. For this reason, the perforator described in the patent referred to above allows a rate which cannot exceed 30 to 40 m/min.

According to another known device, webs are perforated in a continuous manner by means of a rotating system. Thus, patent FR 2 315 367 describes a device comprising a punch support drum driven by a continuous rotation movement around its axis and incorporating, built onto its rim, at least one punch, which is stationary in relation to said drum, and also comprising a web transport support, of the endless type (preferably a drum with an axis parallel to that of the punch support drum), arranged close to the rim of said punch support drum and driven by a continuous movement synchronous with that of the latter, said endless support, on which the web to be perforated is positioned, incorporating at least one die block suitable to cooperate with said punch at the time of the joint movements of said drum and said support. Such devices can operate at very high speeds, but for this purpose they require very high precision mechanisms and, therefore, they are very costly.

Consequently, one of the objects of this invention is to supply a device for carrying out an operation according to a given pitch on a web movable continuously at speeds of up to 100 m/min.

Another object of this invention is to supply a device which can be modified very simply, so as to be able to change the pitch of the operations to be carried out and to be able to pass from one web width to another.

Yet another object of this invention is to supply a device of great precision which only requires very low maintenance.

Another object of this invention is to realise a device of great precision whilst maintaining reduced dimensions.

An additional object of this invention is to supply a device which can be fitted with different types of tools, such as tools for cutting, embossing, stitching, perforation and notching.

Other objects of this invention will appear during the course of the detailed description which follows.

These objects are achieved by producing a device for carrying out an operation, according to a given pitch, on a uniformly and continuously movable web, comprising a first block fitted with a tool describing, in an alternative manner, a short portion of an arc of a circle around a stationary horizontal axis parallel to the movement axis of the web, so as to be able to make said tool cooperate periodically with a member complementary to said tool, which is provided on a second block, said first block being connected to said second block along the stationary axis, the two blocks connected in this way and hung to a stationary frame being driven parallel to the movement plane of said web by a reciprocating movement of magnitude substantially greater than that of the movement of the first block around said stationary axis and of identical period.

In the device according to this invention, the reciprocating movement of magnitude A is provided by means of a structure which can be distorted, comprising, in a plane orthogonal to the plane of the web, two parallelograms which can be distorted, each having two sides parallel to said plane of the web, one of these parallel sides being common to the two parallelograms and driven, according to a a first plane parallel to the plane of the web, by a reciprocating movement of magnitude A/2, the other parallel side of each of two said parallelograms being arranged in one same second plane, said other parallel side of the first parallelogram is stationary, that of the second parallelogram is movable and driven in said second plane by a reciprocating movement of magnitude A, in phase with the movement of magnitude A/2.

Figure 2:
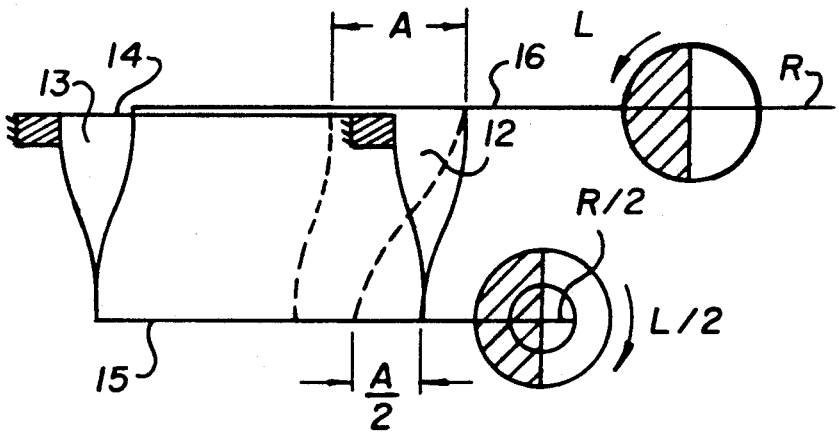
Figure 3A:
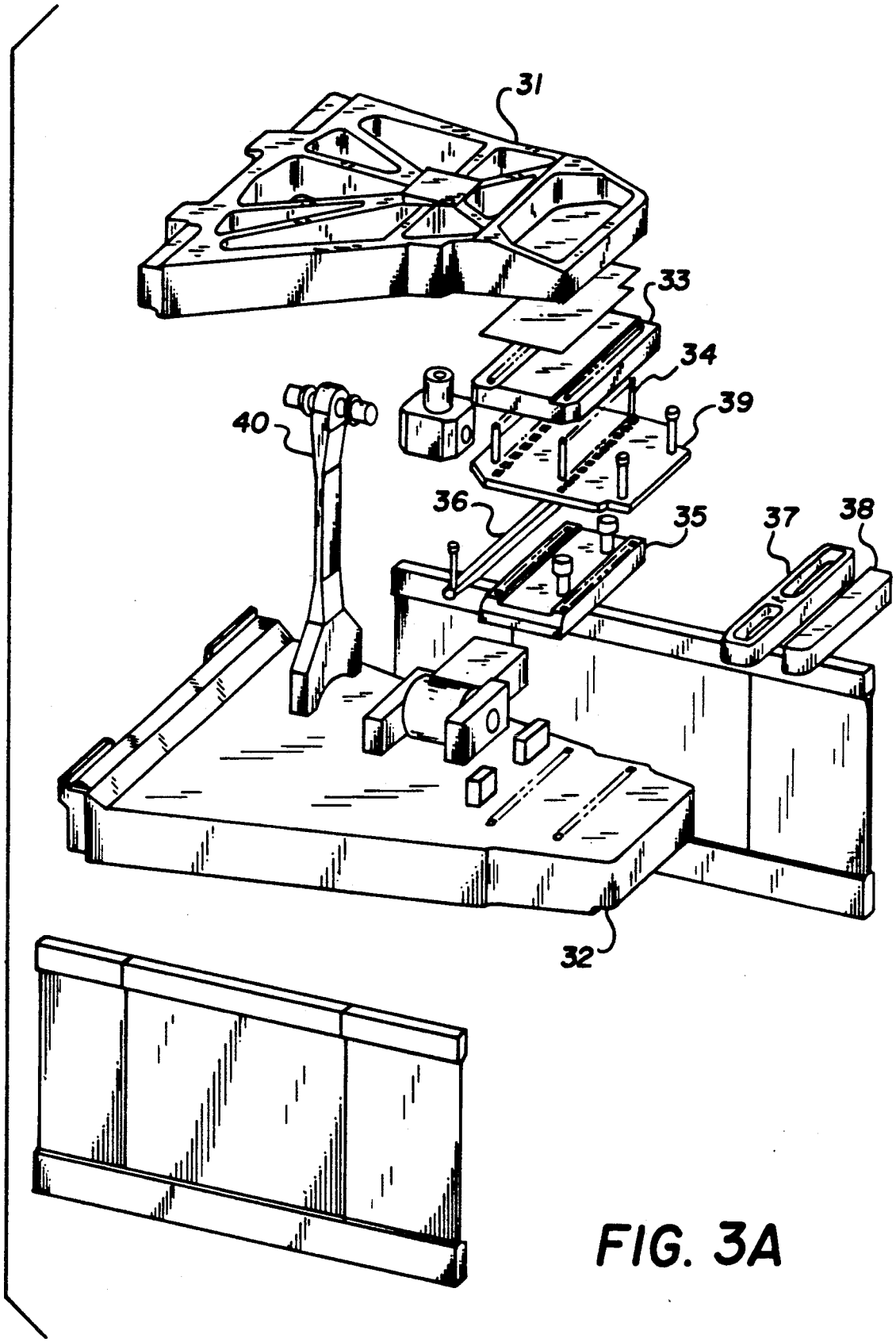
Figure 3B:
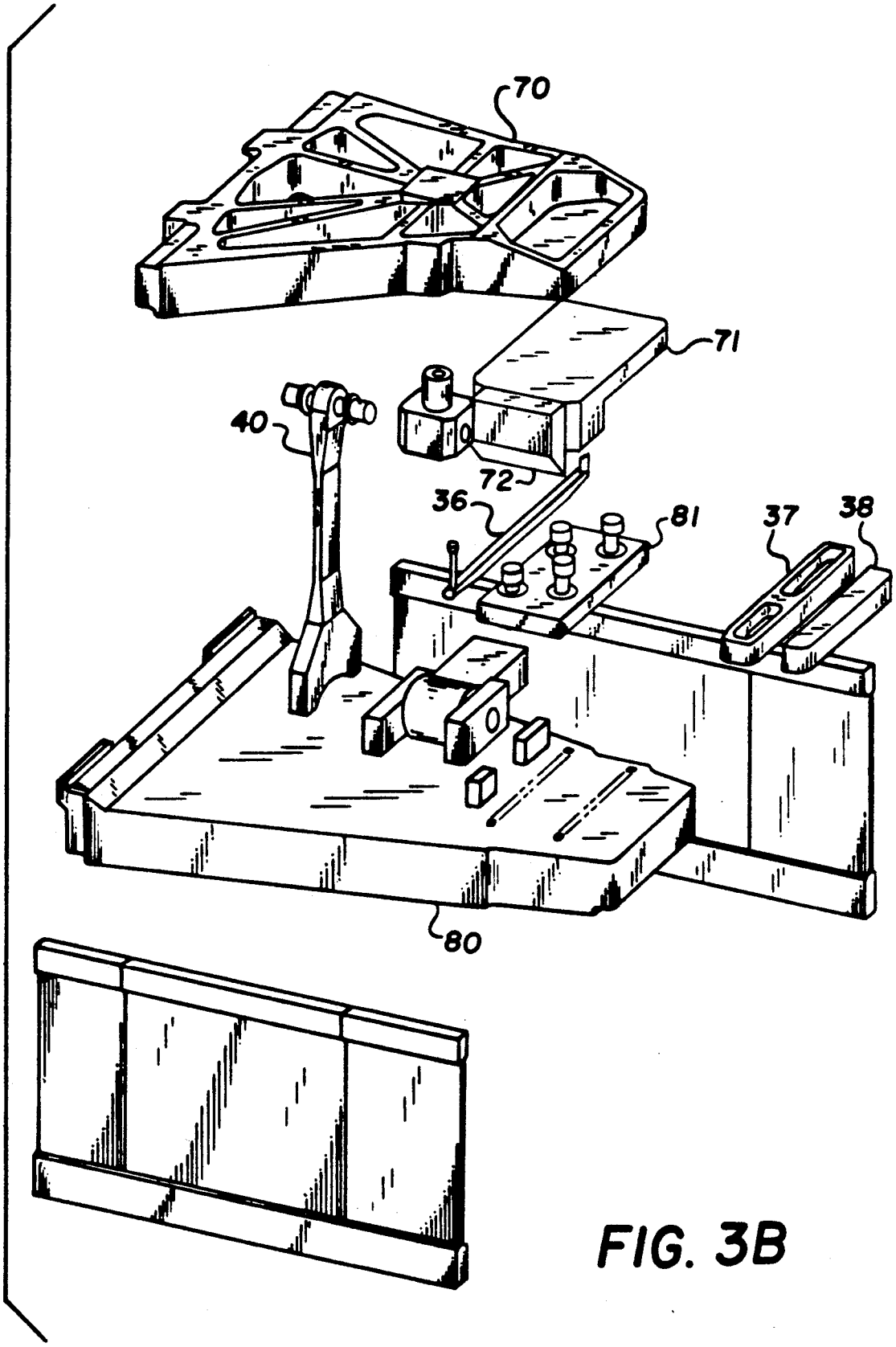
Figure 5:
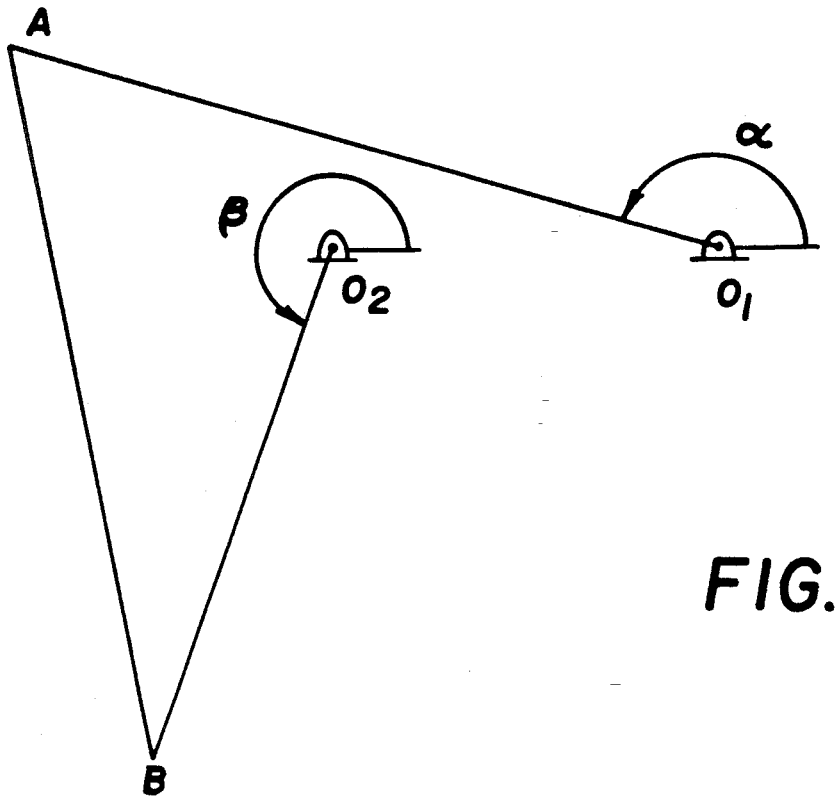
Figure 4:
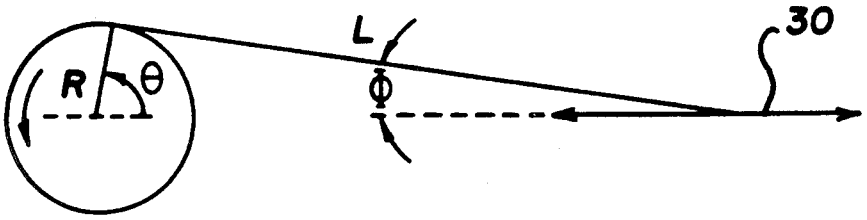
Figure 6:
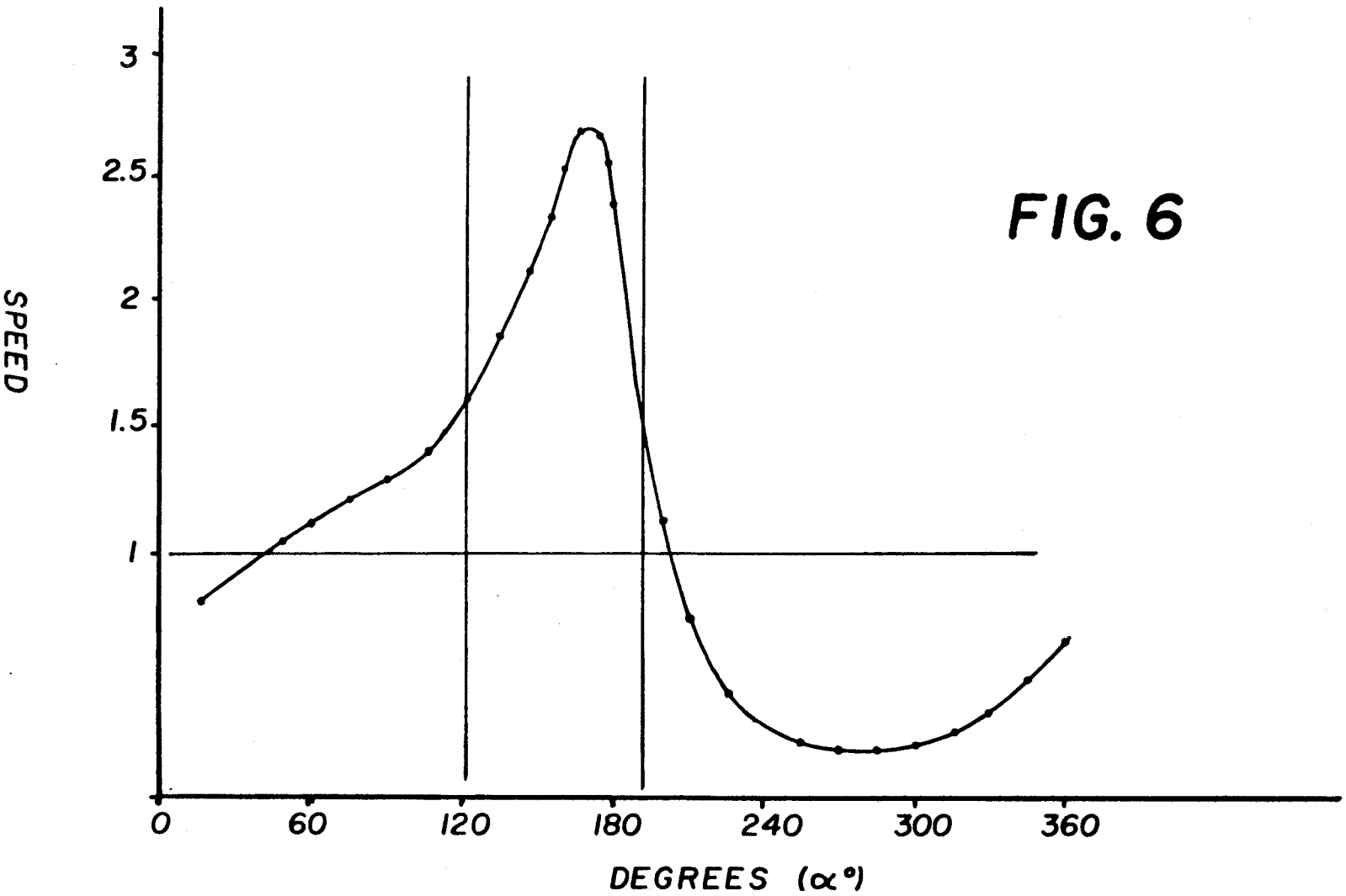
Figure 7:
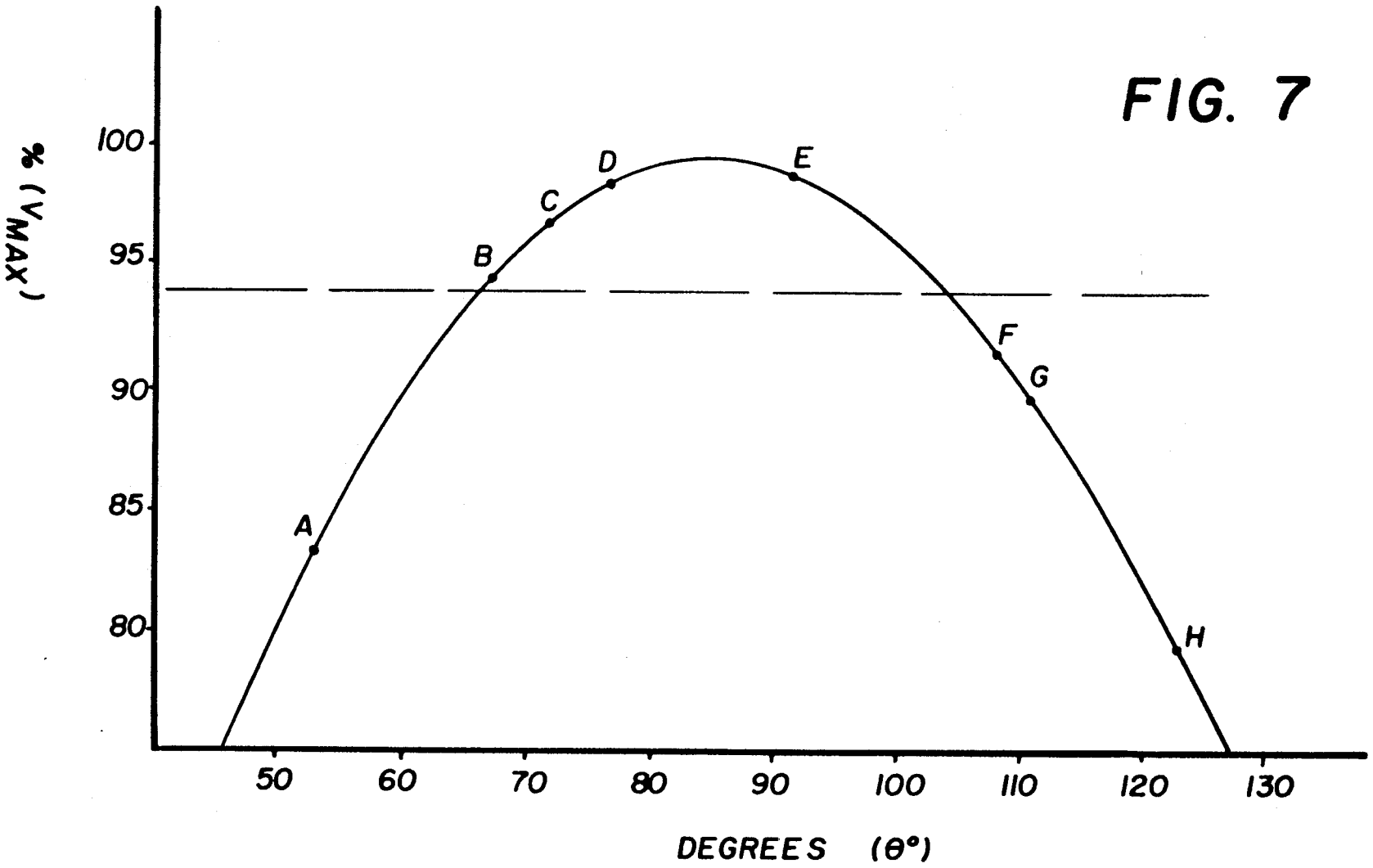
Figure 8:
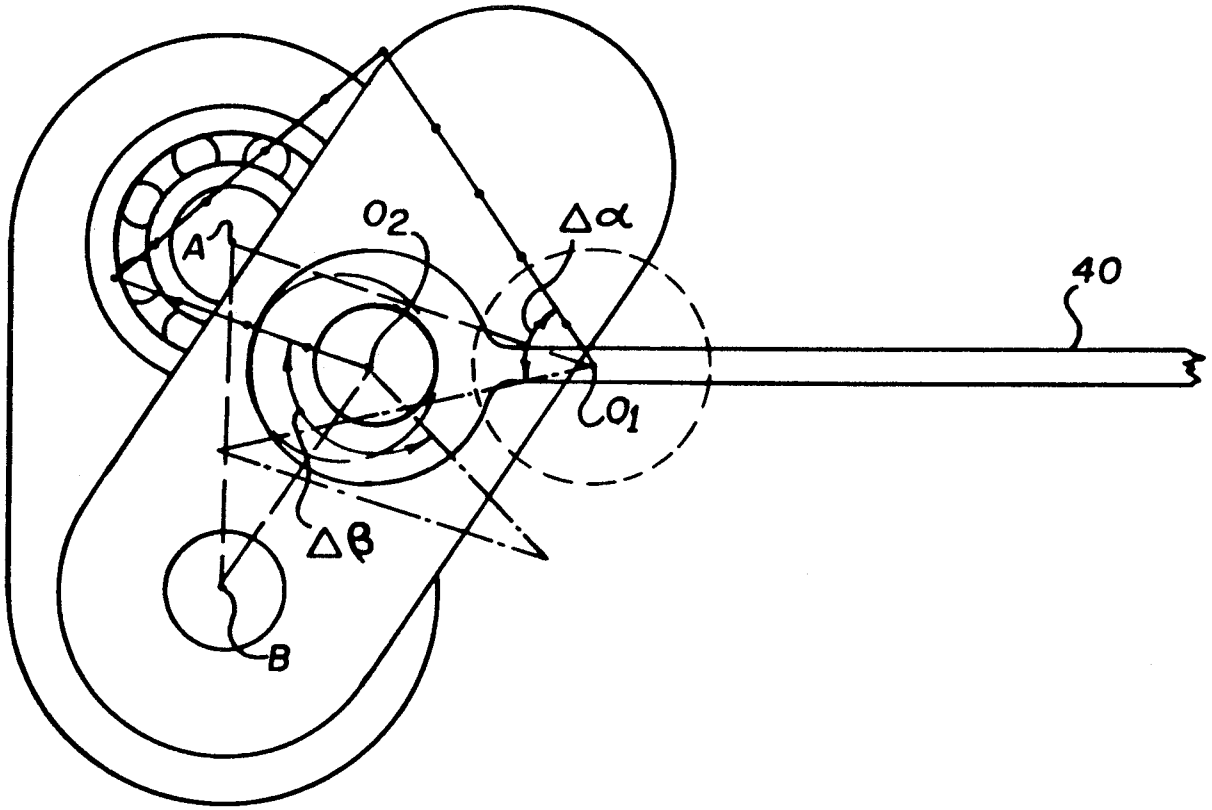
Figure 9:
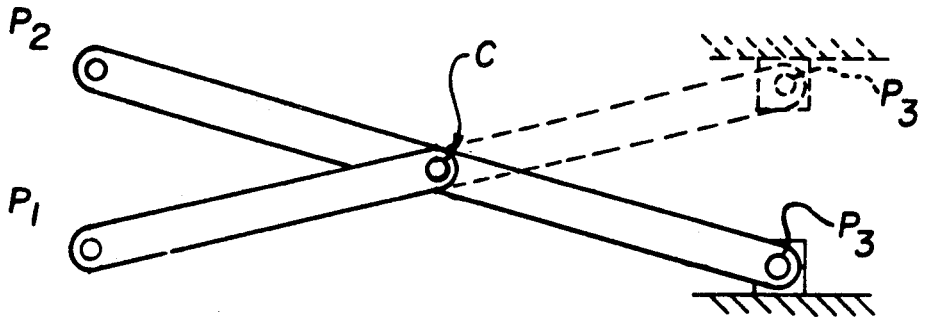
Figure 10:
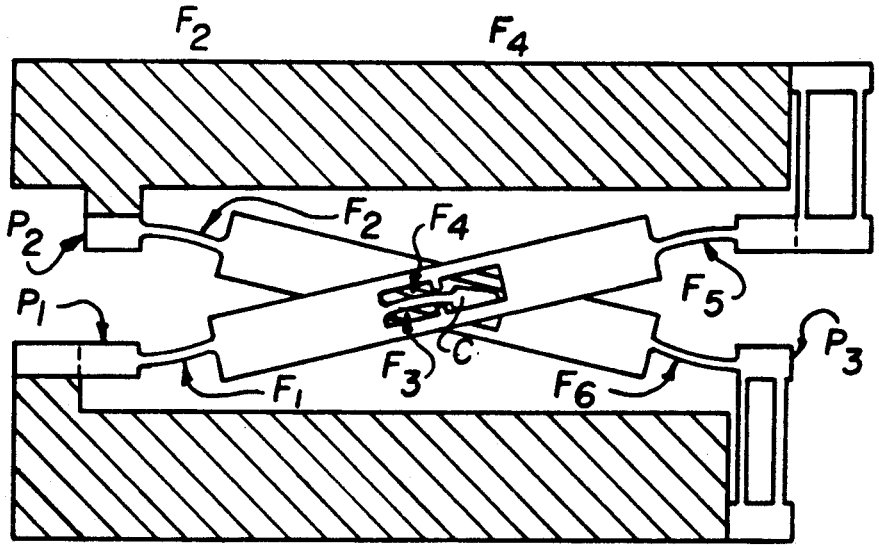

The invention will be described in greater detail making reference to the annexed drawing plates in which:

FIG. 1 diagrammatically represents an embodiment of the device according to this invention, FIG. 2 illustrates, in a general manner, a device making it possible to carry out a reciprocating movement which is perfectly parallel to a plane, FIG. 3A represents an exploded view of the device according to this invention fitted with a perforation tool, FIG. 3B represents an exploded view of the device according to this invention fitted with a cutting tool, FIG. 4 diagrammatically represents a crank-connecting rod mechanism such as those used in the device according to this invention, FIG. 5 diagrammatically represents an example of a device intended to control the movement of the upper block in relation to the lower one, FIG. 6 is a graph representing the speed variations of the control device for the movement of the upper block depending on the angle formed by a driving bar turning at a constant speed, FIG. 7 is a graph representing the speed variations in the reciprocating movement of the device according to this invention, in a plane parallel to the plane of the web, FIG. 8 is a more detailed representation of a device of a type with 4 bars allowing the movement of the upper block to be controlled in relation to the lower one, FIG. 9 diagrammatically represents a mechanism of the SCOTT-RUSSEL type employed in this invention, FIG. 10 represents a SCOTT-RUSSEL mechanism such as is provided in the device according to this invention.

The description of the invention concentrates mainly on a perforating device and, to a lesser extent, on a cutting device; however, it is obvious that its operation would remain unchanged if the device was provided with a tool designed for other types of operations, such as embossing, stitching, punching or notching, the movement required by all these operations being of the same type. All these devices comprise mainly two blocks: one upper block fitted with a given tool, and a lower block equipped with a member complementary to said tool, the arrangement of these two tools being the subject of the detailed description which follows.

With reference to FIG. 1, this diagrammatically represents an embodiment of the device according to this invention.

This device comprises mainly an upper block 1 fitted with, for example, punches 1 and a lower block 2 equipped with, for example, a die block between which the web to be perforated 3 passes in the direction indicated by the arrow 4. At the inlet to the perforating device, the web is arranged so as to form a short, loose loop 5, so as to isolate the perforating device from the traction caused by the passage of the web, and to be able to compensate for the speed differences between said web and said perforating device, which will be examined in more detail below. According to one embodiment, the web passes at a speed of approximately 100 m/min. At the outlet of the perforator, drive mechanisms are provided for the web, for example, of a cog-wheel type which cooperates with the perforations made beforehand. Such mechanisms comprise mainly a first cog wheel 6, and a roll 7 intended to maintain the correct tension in the web upstream from a second cog wheel 8 which acts mainly to isolate the perforating device from speed variations generated by the devices (such as photographic spool assembly structures) positioned downstream from the perforator. The punch block support arm is fastened to the die block support arm along a horizontal axis 9 which is stationary in the space and parallel to the web passage axis, said stationary horizontal axis also corresponds to the joint axis of the punch block support arm 1 in relation to the die block support arm 2, so that the punch block support arm can alternatively describe a short portion of an arc of a circle around said stationary axis 2, in order to be able to make the punches cooperate periodically with the die block during the passage of the web. The link formed in this way between the two blocks is, according to one embodiment, an elastic one comprising two sets of non-coplanar spring blades 10, 11. Each spring blade is fastened at one of its ends by a suitable means to the punch block support arm 1 and at the other end to the die block support arm 2. In the assembly represented in FIG. 1, two side blades are arranged in a first plane parallel to the plane of the web, and a central blade is provided in the plane perpendicular to said first plane. It is obvious that the number of blades on each of the sets may differ from that which is represented in FIG. 1, just as the angle between the two planes may differ from 90°, provided that the punch block support arm always swings around a stationary axis. In fact, such a link behaves as if the punch block support arm were fastened, to a hinge in a fixed position.

This type of joint differs from normal hinges in three important aspects. Firstly, there is no play in this joint. Secondly, there is no need for lubrication and, therefore, maintenance is reduced, as is the danger of splashing oil onto the web; and the accumulation of dust is minimised. Thirdly, the springs produce no friction pairing but, on the contrary, they develop a righting torque which is almost proportional to the angle at which they bend.

According to one embodiment, the blades are constructed of steel and their thickness may vary between 2 and 3 mm, preferably in the order of 2.5 mm, for a free length of blade (i.e. between the two fastening points) of approximately 15 to 20 mm.

The assembly of the two blocks forming the perforating device is hung to the stationary frame in the manner which is now described in detail.

FIG. 2 illustrates in a general manner the device which allows the assembly formed by the punch block support arm and the die block support arm to be moved parallel to the movement of the plane of the web. The device comprises, in a plane orthogonal to the plane of the web, two parallelograms, 12 and 13, which can be distorted, of identical height and each having two sides, 14, 15 and 15, 16, parallel to said plane of the web, one of these parallel sides 15 being common to the two parallelograms and driven, along a first plane parallel to the plane of the web, by a reciprocating movement of magnitude A/2. The other parallel side of each of the two said parallelograms is arranged in a second plane. Said other parallel side 14 of the first parallelogram 13 is stationary, that 16 of the second parallelogram 12 is movable and driven in said second plane by a reciprocating movement of magnitude A in phase with the movement of magnitude A/2. The movable side 16 describing the movement of magnitude A is connected to a first crank-connecting rod system, of which the radius of the crank is R and the length of the connecting rod is L. The movable side 15, common to the two parallelograms and describing a movement of magnitude A/2, is connected to a second crank-connecting rod system, of which the radius of the crank is R/2 and the length of the connecting rod is L/2, the two cranks turning at the same angular speed and, preferably, in opposite phase. The two other sides of each of the two parallelograms are constructed of a flexible material.

With such a device, the movement of magnitude A is always effected in one same plane, on account of the opposite effects resulting from the movements applied to each of the two said parallel sides, as are described above.

According to one particular embodiment, the suspension mechanism in the device in FIG. 1 is based on the principle described with reference to FIG. 2, and it comprises a first 17 and a second 18 flexible and substantially identical member, which are arranged on both sides of the perforating device in the plane orthogonal to said stationary horizontal axis, and each defining a central blade 20 and two side blades, 19 and 21, of identical height.

The lower ends of said side blades and of said central blade of the first member are connected to the lower end of the side blades and of the central blade of the second member, respectively, by means of a joining member 22. According to the embodiment represented in FIG. 1, said joining member is substantially flat and arranged parallel to the plane of the web inside the perforating device, the length of said joining member corresponding substantially to the length of the flexible members. The joining member is arranged in relation to the frame so as to be able to be at least partially free translationally in the direction of the passage of the web. The upper ends of the side blades of each of the flexible members are connected to the frame 23, whilst the lower part of the central blade of each of the members are connected to the die block support arm 2, the two flexible members arranged in this manner defining, when they are not engaged translationally, two parallel surfaces. According to a particular embodiment, the height of these flexible members is in the order of 12.7 cm and the width of the central blade 20 is equal to the sum of the width of the side blades, 19 and 21.

The assembly, composed of the punch block support arm and the die block support arm and arranged in the manner described above, is suitable for movable according to a reciprocating movement perfectly parallel to the passage plane of the web. To this end, the upper part of the central blade of one of the flexible members is coupled to a first crank-connecting rod device 25, of which the crank describes a radius R and the connecting rod is of length L, the lower part of said central blade is, for its part, coupled to a second crank-connecting rod device 24, of which the crank describes a radius R/2 and the connecting rod is of length L/2, said cranks being driven in rotation by means of a shaft 26, 27 turning at the same angular speed and, for reasons of balance, in opposite phase.

The two crank-connecting rod devices are situated in the same plane, substantially to the centre of the central blade. Such a device allows the perforator to obtain a movement perfectly parallel to the passage plane of the web between the punches and the die. This movement is perfectly balanced; it hardly generates any vibration, and therefore it is relatively quiet, the balance being achieved by suitably chosen counterweights 60 which are appropriately positioned. In the embodiment of FIG. 1, the counterweights arranged on each of the eccentrics are identical, and they form an angle of 180° with said eccentrics. Likewise, for reasons of balancing the movement, it is desirable, in contrast to the representation in FIG. 2, to arrange the axes bearing the counterweights one substantially beneath the other, the parallel side common to the two parallelograms being extended in a suitable manner. According to a particular embodiment, the crank-connecting rod devices are realised by means of an eccentric mechanism. For the purposes of more detailed explanations below, a crank-connecting rod mechanism is diagrammatically represented in FIG. 4.

As is represented in FIG. 4, the horizontal reciprocating movement is symbolised by the two-directional arrow 30; L represents the length of the connecting rod; R represents the length of the crank (or of the eccentric); $\theta$ being the angle formed by the crank; and $\Phi$ being the angle formed by the connecting rod. The ratio R:L must be less than 0.25 and, according to a preferred embodiment, it is in the order of 0.1. According to this same embodiment, R is in the order of 9.5 mm, and L is in the order of 105.5 mm.

With reference to FIG. 3A, this represents an exploded view of a perforating device according to this invention. The description given of this figure concentrates more particularly on the means for achieving the perforations themselves, namely the punches and the die block. At its opposite end from its stationary horizontal rotation axis, the upper block 31 is equipped, secured for example by means of screws, with a block 33 fitted with the punches 34. In the embodiment represented, the punches are arranged in the form of two arrays, each comprising at least two punches and arranged in relation to each other parallel to the axis of the web. The two arrays are spaced so as to be able to perforate the two edges of said web according to a given pitch. Each array of punches is provided, at its opposite end from the inlet edge of the web, with at least one guide pin (not represented) greater in length than that of the punches and arranged so as to engage with one of the perforations made previously and just before the punches come into contact with the film, to perforate it, so as to arrange with precision the punches on said web. According to one embodiment, each array comprises twelve punches and three guide pins, but it is obvious that any other arrangement of said punches and said guide pins is possible. Likewise, by way of example, the difference in length between the punches and the guide pins is in the order of 1.2 mm. A die block 35 is fastened onto the end of the lower block 32, referred to as die block support arm; this is provided with holes designed to cooperate with the punches, the lower block 32 on which the die is mounted being itself provided with holes designed for removable pieces of web resulting from the perforations. On each side of the die, devices are provided which are intended to accurately guide the web at the time of its passage. These devices consist of a first flexible guide 36, which can be in the form of an S-shaped spring blade, and which is arranged on one of the edges of the die block, the other edge being provided with a stationary guide 37 and a positioning block 38 allowing the position of the guide to be adjusted in rotation, and also making it possible to adjust its spacing in relation to the flexible guide. These adjustments are made in a manner known in the art, for example by means of suitable screws. The die block support arm also consists of a stripper block 39, which is arranged in a spaced manner in relation to the die block in registration with said die block. This stripper block is designed to hold the web at the time the punches leave said web after having perforated it, the web passing between the die 35 and said stripper block 39. By way of example, the spacing between the die and the stripper block is in the order of 0.5 mm.

FIG. 3B represents an exploded view of a cutting device according to this invention. As is represented in FIG. 3B, at its opposite end from its stationary horizontal rotation axis, the upper block 70 is fitted with a member 71 equipped, on one of its ends perpendicular to the passage axis of the web, with a knife 72, the lower block 80 comprising a member 81 arranged so as to form a bedknife cooperating with said knife 72. The other members of said cutting device are identical to those described with reference to the perforating device.

The mechanism for controlling the movement of the punch block support arm around said stationary horizontal axis, must be such that it allows the engagement time to be minimised between the punches and the web, since during this engagement time, corresponding to the actual perforation time, it is necessary to ensure a very precise synchronisation between the movement of the web and the movement of the perforator, so as to ensure that the speed of the web is substantially equal to the horizontal speed of the punches during perforation.

To this end, the movement of the punch block support arm around said stationary horizontal axis is achieved by means of a device with two rotating axes, in which a uniform rotation speed of a motor axis produces a speed varying continuously during each revolution of the axis controlling the movement of the punch block support arm, said uniform rotation speed of the motor axis being equal to the rotation speed of the crank-connecting rod devices controlling the reciprocating movement, parallel to the plane of the web, of said perforating device. According to one embodiment, this device with two rotating axes is, as is diagrammatically represented in FIG. 5, of a four-bar linkage type. A first bar $O_1A$, provided on the motor axis $O_1$, is driven in rotation at a constant speed. According to one embodiment, this speed is in the order 1 600 rpm. The second bar $O_2B$ is on the control axis $O_2$ and it turns at a variable speed; a third bar AB connects the free ends of the two first bars, the fourth bar being formed by the stationary distance $O_1O_2$ separating the two axes. In the description which follows, the angle formed by the first bar $O_1A$ will be referred to as $\alpha$, and the angle formed by the second bar on the control axis $O_2$ is referred to as $\beta$. The dimensions of the bars must be such that they confirm the following relations :

1) $AB > O_1O_2 + O_1A - O_2B$

2) $AB > O_1A - O_1O_2 + O_2B$

FIG. 8 represents in greater detail this device of the four-bar linkage type. According to a particular embodiment, $O_1A = 2.54$ cm, $AB = 2.48$ cm, $O_2B = 1.84$ cm, and $O_1O_2 = 1.46$ cm. The control axis $O_2$ is connected to the punch block support arm by means of a crank-connecting rod mechanism 40 which may be of the type with eccentric. According to one embodiment, the length of the eccentric is in the order of 1.8 mm. As is represented in FIG. 3, the connecting rod 40 controlled by said eccentric is connected to the punch block support arm at a point situated between the stationary horizontal axis and the arrays of punches, such that the punches describe a substantially vertical movement of magnitude in the order of 4.5 mm. (In fact, this concerns an arc of a circle of very small magnitude ($\approx 2°$)). The magnitude of the substantially vertical movement is less, by approximately 75%, than the magnitude of the vertical movement of devices known until now and this, for a same magnitude of movement in the direction of the web. According to this invention, the punch block support arm substantially describes a dissymetrical ellipse in relation to a horizontal axis. Such an arrangement makes it possible to be able to increase the thickness of the spring blades forming the elastic connection and, therefore, to increase the rigidity of the system.

For reasons of synchronisation, the motor axes controlling the horizontal movement, as well as the motor axis controlling the vertical movement, are driven at the same speed by means of a single motor.

FIG. 6 represents the variations in the angular speed of the bar $O_2B$ according to the angle $\alpha$ formed by the bar $O_1A$ provided on the motor axis and turning at a continuous speed, said continuous speed being represented by the straight line parallel to the axis of the abscissae. The average value of the angular speed of the bar $O_2B$ is, of course, equal to the angular speed of the motor axis, but said speed of the bar $O_2B$ is, in momentary value, sometimes faster and sometimes slower than the speed of the motor axis. With the object of minimising the contact time of the punches with the web, the eccentric controlling the movement of the punch block support arm must, of course, be chosen and arranged so that the perforation is actually made during a period in which the speed of the bar $O_2B$ is at its maximum (marked out by the two vertical lines in FIG. 6), this period having to coincide with the period in which the speed of the reciprocating movement of the perforator is substantially identical to that of the web.

With reference to FIG. 7, this represents a graph showing the speed of the reciprocating movement of the perforator during a part of the period of the movement of the crank controlling said movement. This gives, in the abscissa, the angle $\theta$ formed by the crank and, in the ordinate, the horizontal movement speed of the perforator (as a % in relation to the maximum speed of said movement). The uniform movement speed of the film is also represented by a straight line parallel to the axis of the abscissae corresponding, in this particular embodiment, to a speed of 100 m/min. Several points representing particular positions of the punches and guide pins have been plotted on the curve; in this example, they have the following values : R=9.5 mm and L=105.4 mm; penetration of the punches=0.25 mm; difference in length between the punches and the guide pins=1.1 mm; and the drive speed of the crank=1 600 rpm.

These particular positions are as follows:

point A: the guide pins reaching the stripper block; $52° < \theta < 58°$ point B: the guide pins reaching the plane of the web point C: the guide pins are arranged in the corresponding previous perforations point D: the punches arriving in contact with the web point E: the punches perforating the web; they are at the limit of their travel point F: the punches leave the plane of the web point G: the guide pins leave the plane of the web point H: the guide pins leave the stripper block $122° < \theta < 128°$.

The angle $\theta$ included between the moment at which the guide pins reach the stripper block and the moment at which said guide pins leave said stripper block, is also referred to as the engagement angle and, according to this embodiment, is in the order of 70°. From point B to point H, it is necessary that the speed of the web is substantially identical to the horizontal speed of the perforator. Between these two points, the short period during which the horizontal speed is greater than the speed of the web, is compensated for by forming a loose loop with the web, just upstream from the perforator. This engagement angle, of approximately 70°, corresponds also to an angle of approximately 70° with the bar connected to the motor axis $O_1$ of the four-bar linkage mechanism referred to above. When said bar, connected to the motor axis, covers this angle $\alpha=70°$ at a constant speed of 1 600 rpm , the bar connected to the control axis $O_2$ covers an angle $\beta=153°$, at the variable speed such as marked out by the two vertical lines represented in FIG. 6. According to a particular embodiment, this engagement angle of 70° corresponds, in the example used, to the interval $\Delta\alpha=[121°-191°]$ for the crank provided on the motor axis and to the interval $\Delta\beta=[161°-314°]$ for the crank provided on the control axis $O_2$. These intervals are shown in the diagram of FIG. 8. This angle of 70° for a drive speed of 1 600 rpm. represents a period of approximately 7 ms.

As is represented in FIG. 1, the perforating device according to this invention comprises, between the punch block support arm and the die block support arm, a mechanism derived from a SCOTT-RUSSEL mechanism and consisting of an X-shaped member, 50, such that it allows a movement of the punch block support arm around the stationary horizontal axis, but prevents any side movement of one of the blocks in relation to the other, thereby enabling the rigidity of the system to be increased. A conventional SCOTT-RUSSEL mechanism is represented by continuous lines in FIG. 9. Such a device forces the point $P_2$ to move according to a movement perpendicular to the straight line between $P_1$ and $P_3$. The broken lines represent a variation of the SCOTT-RUSSEL mechanism making it possible, by mirror effect, to obtain the effects of two SCOTT-RUSSEL mechanisms. Such an arrangement increases the resistance to the side movement between the blocks. FIG. 10 diagrammatically represents an example of an arrangement of such a mechanism between the punch block support arm and the die block support arm. The joints represented in FIG. 9 at points $P_1$, $P_2$, $P_3$ and C are replaced by the flexible members $f_1$-$f_6$, thereby increasing the resistance to the side movement. The distortions in the flexible members $f_1$-$f_6$ are such that they retain the geometric relations required for such a mechanism, viz $P_1C=P_2C=P_3C$.

The dimensions of the device according to this invention are, for the embodiment represented in FIG. 1, in the order of 41 cm×37 cm×25 cm.

We claim:

1. Device for carrying out an operation, according to a given pitch, on a uniformly and continuously movable web, comprising a first block (1) provided with a tool, which describes, in a reciprocating motion, a short portion of an arc of a circle around a stationary horizontal axis (9) parallel to the movement axis of the web, to make periodically cooperate said tool with a member complementary to said tool, provided on a second block (2), said first block being connected to said second block at the level of said stationary horizontal axis, both blocks connected and hung in this way to a stationary frame (23) being driven parallel to the movement axis of said web in a reciprocating movement of magnitude substantially greater than that of the movement of the first block around said stationary axis and of identical period.

2. Device according to claim 1, characterised in that said reciprocating movement of magnitude A is ensured by means of a structure which can be distorted comprising, in a plane orthogonal to the plane of the web, two parallelograms which can be distorted each having two sides parallel to said plane of the web, one of these parallel sides being common to the two parallelograms and driven, according to a first plane parallel to the plane of the web in a reciprocating movement of magnitude A/2, said other parallel side of the first parallelogram is stationary, that of the second parallelogram is movable and driven in said second plane in a reciprocating movement, of magnitude A and in phase with the movement of magnitude A/2.

3. Device according to claim 2, characterised in that the two other sides of said parallelograms are constructed of a flexible material.

4. Device according to claim 1, characterised in that the reciprocating movement is provided by means of a mechanism comprising a first and a second flexible member, (17) and (18), arranged on both sides of said device in the plane perpendicular to said stationary horizontal axis and each defining a central blade (20) and two side blades, (19) and (21), the lower end of said side blades and of said central blade of said first member being respectively connected to the lower end of the side blades and with the central blade of said second member by means of a joining member (22) arranged parallel to the plane of the web, said joining member being partially free translationally in the direction of movement of the web, said side blades of each of the flexible members having their upper end connected to the frame, said central blades of said flexible members having their upper end being connected to said second block, the central blade of one of the flexible members having its upper end connected to a first crank-connecting rod device (25), of which the crank describes a radius R and the connecting rod is of length L, and having its lower end connected to a second crank-connecting rod device (24) of which the crank describes a radius R/2 and the connecting rod is of length L/2, said cranks turning at the same angular speed and in opposite phase.

5. Device according to claim 4, characterised in that the magnitude of the reciprocating movement is in the order of 20 mm.

6. Device according to claim 4, characterised in that the crank-connecting rod device is achieved by means of a mechanism with eccentric.

7. Device according to claim 4, characterised in that the ratio R:L is less than 0.25.

8. Device according to claim 1, characterised in that the link from the first block to the second block is an elastic one comprising two sets of non-coplanar spring blades, (10) and (11), the intersecting straight line of the two planes corresponding to the stationary horizontal axis (9) around which said first block swings, one end of each spring blade being fastened to said first block (1) and the other to said second block (2).

9. Device according to claim 8, characterised in that one of said planes is parallel to the plane of the web, the other plane being substantially perpendicular to the first.

10. Device according to claim 8, characterised in that the thickness of said blades lies between 2 and 3 mm.

11. Device according to claim 1, characterised in that the movement of said first block around said stationary horizontal axis is achieved by means of a device with two rotating axes in which a speed of uniform rotation of a motor axis produces a speed varying continuously during each revolution of the axis controlling the movement of said first block around said stationary horizontal axis, said speed of uniform rotation of the motor axis being equal to the speed of rotation of the crank-connecting rod devices controlling the reciprocating movement of said device parallel to the plane of the web.

12. Device according to claim 11, characterised in that the device with two rotating axes is of a four-bar linkage type, a first bar $O_1A$ on the motor axis, and a second bar $O_2B$ on the control axis, the two said bars having their free end connected to a third bar AB, and the fourth bar consisting of the fixed distance $O_1O_2$ separating the two said axes.

13. Device according to claim 12, characterised in that the control movement of the first block is transmitted to said first block by a mechanism with eccentric.

14. Device according to claim 1, characterised in that a flexible device (50) is provided between the first block and said second block, parallel to said stationary horizontal axis, derived from a mechanism of the type such as a SCOTT-RUSSEL mechanism, so as to prevent any translational movement, in the direction of the movement axis of the web, by said first block in relation to said second block.

15. Device according to claim 1, characterised in that it is fitted with a perforating tool, said first block having a series of punches, said second block having a die block suitable to cooperate with said punches.

16. Device according to claim 15, characterised in that the punch block support arm comprises two arrays of punches, each comprising at least two punches, arranged opposite each other, parallel to the axis of the web and spaced so as to be able to perforate the two edges of said web, according to a given pitch, each array being provided at its end opposite the inlet edge of the web with at least one guide pin of length greater than that of the punches, arranged so as to engage with one of the perforations made previously and just before the punches come into contact with the film, to perforate it, in order to accurately position the punches on said web.

17. Device according to claim 16, characterised in that each of said arrays comprises twelve punches and three guide pins.

18. Device according to claim 16, characterised in that the length difference between the punches and the guide pins is in the order of 1.2 mm.

19. Device according to claim 1, characterised in that it is fitted with a cutting tool, said first block being provided with a knife, said second block being provided with a bedknife suitable for cooperating with said knife.

20. Device according to claim 1, characterised in that it is fitted with a stitching tool.

21. Device according to claim 1, characterised in that it is fitted with an embossing tool.

22. Device according to claim 1, characterised in that it is fitted with a notching tool.

* * * * *